US005570602A

United States Patent [19]

Bauer

[11] Patent Number: 5,570,602

[45] Date of Patent: Nov. 5, 1996

[54] APPARATUS FOR INTERNAL HIGH-PRESSURE MOLDING

[75] Inventor: Anton Bauer, Schwalbach, Germany

[73] Assignee: Huber & Bauer GmbH, Dillingen, Germany

[21] Appl. No.: 375,486

[22] Filed: Jan. 19, 1995

[30] Foreign Application Priority Data

Jan. 29, 1994 [DE] Germany ..... 44 02 674.9

[51] Int. Cl.[6] ..... B21D 26/02

[52] U.S. Cl. ..... 72/61; 72/62; 72/455

[58] Field of Search ..... 72/54, 59, 60, 72/61, 62, 63, 455

[56] References Cited

U.S. PATENT DOCUMENTS

| | | | |
|---|---|---|---|
| 2,344,779 | 3/1944 | Kolderman et al. | 72/62 |
| 3,005,431 | 10/1961 | Moller | 72/63 |
| 3,391,559 | 7/1968 | Myers | 72/63 |
| 4,305,270 | 12/1981 | Kokovikhin et al. | 72/60 |

FOREIGN PATENT DOCUMENTS

| | | |
|---|---|---|
| 342356 | 9/1904 | France . |
| 1370852 | 4/1964 | France . |
| 2707152 | 8/1978 | Germany . |

*Primary Examiner*—David Jones
*Attorney, Agent, or Firm*—Darby & Darby, P.C.

[57] ABSTRACT

In an apparatus for molding particularly a tubular blank (1) of a ductile metal with internal high pressure in a mold, which has a cavity (5), a lower part (2) and a removable upper part (3) as well as a mechanism (6, 7, 13–21) for holding the upper (3) and lower parts (2) together, this mechanism consists of a pot (7), which is provided with a lid (15) and in which the mold (2, 3) is inserted. Between the pot (7) and the lid (15), a bayonet lock (13–20) is provided with a row of interlocking devices (14, 19), which can be brought into and out of engagement by means of a ring (16), which can be rotated relative to the mold (2, 3), and with an annular (9; 21) introduction of force into the lower part (2) and the upper part (3) near their circumference. Said ring (16) is disposed at a lid (6), which is mounted on the upper part (3) of the mold and can be rotated by means of a hydraulic cylinder (17) acting with a tangential force component between the remaining lid (15) and the ring (16) over oscillating cranks (18) hinged at the remaining lid (15) and the ring (16) with approximately radial extent.

13 Claims, 2 Drawing Sheets

APPARATUS FOR INTERNAL HIGH-PRESSURE MOLDING

BACKGROUND OF THE INVENTION

The invention relates to an apparatus for molding particularly a tubular blank of a ductile metal with internal high pressure in a mold having a cavity, a lower part and a removable upper part as well as a mechanism for holding the upper and lower parts together.

This mechanism, on the one hand, must absorb large forces and, on the other, permit the upper part to be lifted from the lower part during each manufacturing process, so that the workpiece can be inserted and removed. The mold is therefore normally inserted in a sort of press frame and the upper part is arranged therein, so that it can be raised and lowered, like the top ram of a press.

SUMMARY OF THE INVENTION

It is an object of the invention to reduce this structural expense.

Pursuant to the invention, this objective is accomplished owing to the fact that as shown in French Patent 1,370,852, said mechanism has a bayonet lock with at least four interlocking devices on a circumference, which encloses the horizontal outline of the mold, which interlocking devices can be brought into and out of engagement by a ring that can be rotated relative to the mold, and in that the ring is disposed on a lid for the pot, which is connected with the upper part of the mold and can be twisted by hydraulic cylinders acting with a tangential force component between the lid and the ring.

For this solution, the forces are not as in French Patent 1,370,852 absorbed by the frame that continues to be required for raising and lowering the upper part of the mold, but are equalized directly at the mold between the upper part and the lower part. The opening and closing of the mold can be carried out relatively easily and quickly with the rotatable ring. The actuation of the ring is not, as in French Patent 1,370,852, from a fixed base located outside, but from a lid located inside the ring on the upper part of the mold. This gives to the lid and upper part of the mold absolute clearance for movement. Preferably hydraulic cylinders act on the ring over oscillating cranks hinged at the lid and the ring with approximately radial extent.

The bayonet lock can be realized and mounted in various ways. According to a preferred embodiment of the invention, the mechanism is approximately pot-shaped and the mold is inserted in it.

It is, however, entirely possible, for example, to have the ring take hold, for example, only behind teeth disposed on the lower part as a border. Combinations of these solutions and transition solutions between the pot and the adjoining configuration of the bayonet lock are also possible.

It is necessary to introduce the forces into the lower part and the upper part near their periphery and at least four places, in order to keep the mold, which would bend open, for example, only between two mutually opposite joints, reliably closed. Preferably, however, the bayonet lock has at least eight interlocking devices and, better yet, an uninterrupted row of interlocking devices and the mechanism preferably then transmits the force continuously circularly into the lower part and the upper part. The circular or punctiform introduction of force near the periphery, however, permits forces to be introduced further inside and, for example, the bottom of the lower part to be supported all over and to be pressed all over against the upper side of the upper part. Particularly (but not exclusively), the mold can then also be smaller than the interior of the pot and also have a non-circular shape, for example, a rectangular and, particularly, a square shape.

Further measures, which can lead to an advantageous development of the invention, are listed in the following description of an embodiment.

BRIEF DESCRIPTION OF THE DRAWINGS

The embodiment is reproduced in the drawings, in which.

DETAILED DESCRIPTION OF THE INVENTION

Figure 1:
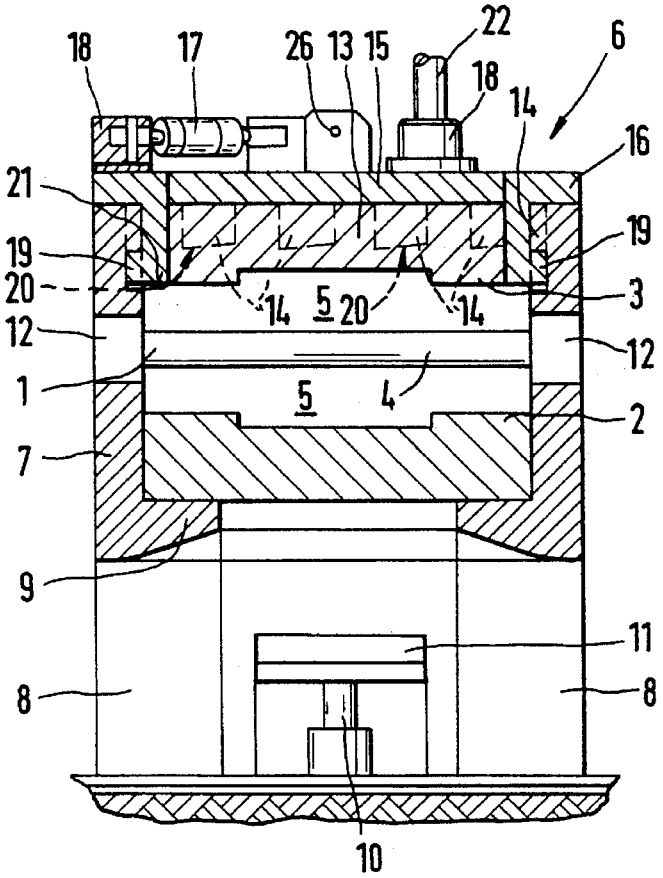
FIG. 1 shows a perpendicular section through a mold and a mechanism, which holds the lower part and the upper part of the mold together.
Figure 2:
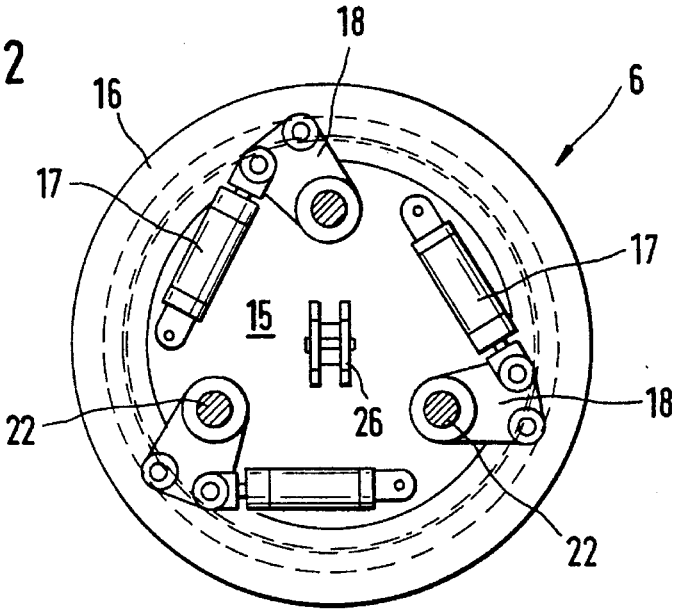
FIG. 2 shows a plan view of the arrangement of FIG. 1

A mold for molding a tubular blank 1 with internal high pressure consists of a lower part 2 and an upper part 3, which join together in the horizontal sectional plane 4 in the blank 1. The mold cavity 5 of the mold is shown diagrammatically.

The mold is inserted into a pot 7 that is provided with a lid 6.

The pot 7, resting on an annular substructure 8 takes hold of the lower part 2 with an only annular base 9. A ram plate 11, which can be raised and lowered by a cylinder 10, is disposed in the thus existing cavity below the lower part 2 and permits rams (not shown), exerting an effect in the mold, to be disposed, in order to press a hollow in the mold after the high-pressure molding or slowly to release a cavity for forming a connection piece during the action of the high pressure, etc.

In the extension of the tubular blank 1, the side wall of the pot 7 has two recesses 12, through which connections for the pressure medium can be advanced against the tubular blank 1. At the top, a border of teeth 14 has been worked into the inside of the top wall by a circumferential milling 13.

The lid 6 consists of a plate 15 and a ring 16, enclosing the plate 15 and protruding further downward. The two parts are connected together by a simple collar, which is not shown. The upper part 3 is fastened to the plate 15. The ring 16 can be rotated relative to the plate 15 by means of three hydraulic cylinders 17 and three oscillating cranks 18. The oscillating cranks 18 are hinged at the plate 15 as well as at the ring 16 in such a manner, that the straight line, connecting the two joints, is, on the average, aligned approximately radially. The hydraulic cylinders 17 are hinged to the plate 15 and the oscillating cranks 18 so as to be aligned, as far as possible, in a tangential direction.

A border of outwardly directed teeth 19 is integrally molded to the section of the ring 16 extending downward. When the lid 6 is placed on the pot 7 between the teeth 14 of the latter, the teeth 19 move downward and, by twisting the ring 16, are then pushed below the teeth 14. Due to the inclined surfaces 20 at the two teeth 14, 19, a clamping force results, with which the ring 16 presses onto a flange-like shoulder 21 of the upper part 3.

The lower part 2 and the upper part 3 of the mold are pressed against one another and held together in this manner. The displacement forces for the locking are compensated for within the pot/lid/mold unit. The ring 16 could also be rigidly connected with the plate 15. In this case, however, the latter would also have to be twisted relative to the upper part 3.

Figure 3:
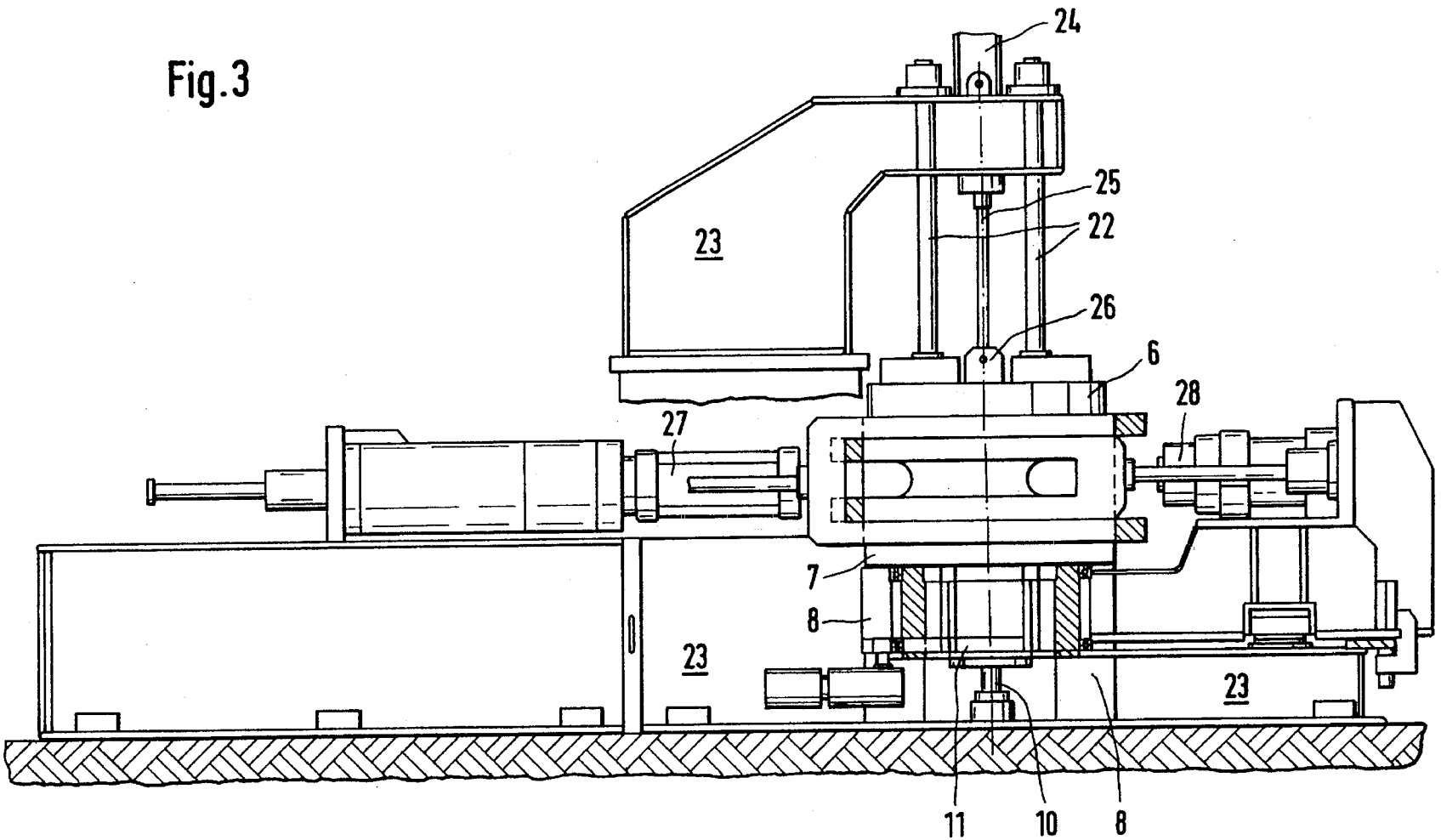
FIG. 3 shows the overall arrangement of the mold and the mechanism in a frame in side view.

The arrangement described appears in FIG. 3 in a side view, which corresponds to a section through FIG. 1. However, the arrangement is largely hidden and has been modified. The substructure 8, the cylinder 10, the ram plate 11, the pot 7 and the lid 6 can be recognized. The axles of the three inner joints of the oscillating cranks 18 have been elongated upward as guide rods 22 and passed movably through the upper beam of a frame 23, which is basically C-shaped and represents the machine frame. In the middle in between, the piston rod of a lifting cylinder 24 is mounted in the upper beam of the frame as a connecting rod 25 to an attachment 26 at the lid 6. The aforementioned pressure-medium connections, which can be moved towards the tubular blank 1, are hidden. However, the outlet and advance facilities 27 and 28 in question can be seen.

The tubular blank 1 is always inserted with the lid 6 and the upper part 3 being lifted at the underside of the latter in clamps. The lid 6 with the upper part 3 hanging from it is then lowered by the lifting cylinder 24. The teeth 19 on the ring 16 of the lid slide downward between the teeth 14 on the pot 7. After the upper part 3 is placed on the lower part 2, the ring 16 is rotated by actuating the hydraulic cylinder 17. The bayonet lock, represented by the construction, is then locked by these means in the manner already indicated and the upper part 3 and the lower part 2 are held together. The pressure-medium connections are advanced and are connected with the tubular blank 1. The blank is expanded by forcing in hydraulic liquid with, at the end, a pressure of, for example, 6,000 bar and pressed, as stated, against the wall of the mold cavity 5, which is shown only diagrammatically. The shaped workpiece is formed in this manner.

After the molding process, the events described above take place in the reverse direction and sequence.

I claim:

1. An apparatus for molding a tubular blank of a ductile metal with internal high pressure, said apparatus comprising:

a mold having a cavity, a lower part and an upper pan which is removable from said lower part and is mounted at a frame so that it can be raised and lowered; and a mechanism for holding said upper and lower parts together, said mechanism having a lid mounted on said upper part, a bayonet lock with at least four interlocking devices on a circle enclosing said mold, and a ring mounted on said lid, said ring bringing said interlocking devices into and out of engagement through rotation relative to said mold, and with the introduction of force near the circumference of and into said lower part and said upper part, said mechanism further comprising a hydraulic cylinder acting with a tangential force component between said lid and said ring to rotate said ring.

2. The apparatus of claim 1, wherein an annular force is introduced into one of said lower part and said upper part.

3. The apparatus of claim 1 or 2, wherein said bayonet lock has at least eight interlocking devices.

4. The apparatus of claim 3, wherein said bayonet lock has an uninterrupted row of locking devices.

5. The apparatus of claim 1 or 2, Wherein said lid is held in said frame by guide rods and a connecting rod.

6. The apparatus of claim 5, wherein said connecting rod is actuated hydraulically.

7. The apparatus of claim 1 or 2, wherein said workpiece is held in clamps in said upper part of said mold.

8. The apparatus of claim 1 or 2, wherein said hydraulic cylinders act on said ring over oscillating cranks hinged at said lid and said ring with approximately radial extent.

9. The apparatus of claim 8, wherein said ring presses directly on said upper part.

10. The apparatus of claim 9, wherein said upper part has a flange-like shoulder and said ring presses on said flange-like shoulder.

11. The apparatus of claim 1, wherein a portion of said mechanism is constructed pot-shaped and in that said mold is inserted into said pot-shaped portion of said mechanism.

12. The apparatus of claim 11, wherein said pot-shaped portion of said mechanism has a side wall, and said interlocking devices comprise outwardly protruding teeth on said ring and counterparts on said side wall, said teeth of said ring gripping underneath said counterparts on said side wall.

13. The apparatus of claim 11, wherein an annular force is introduced into one of said lower part and said upper part.

* * * * *

UNITED STATES PATENT AND TRADEMARK OFFICE

CERTIFICATE OF CORRECTION

PATENT NO. : 5,570,602

DATED : November 5, 1996

INVENTOR(S) : Anton BAUER

It is certified that error appears in the above-indentified patent and that said Letters Patent is hereby corrected as shown below:

Title page,
Item [30] Foreign Application Priority Data:
"44 02 674.9" should be --P 44 02 674.9--

Claim 1, line 4 (Col. 3, line 46):
"pan" should be --part--.

Signed and Sealed this

Fourteenth Day of January, 1997

Bruce Lehman

*Attest:*

BRUCE LEHMAN

*Attesting Officer*

*Commissioner of Patents and Trademarks*